US010334936B2

(12) United States Patent
Scicluna

(10) Patent No.: US 10,334,936 B2
(45) Date of Patent: Jul. 2, 2019

(54) CHECKPOINT-FRIENDLY BACKPACK

(71) Applicant: TUMI, INC., Edison, NJ (US)

(72) Inventor: Paul V. Scicluna, Penndel, PA (US)

(73) Assignee: TUMI, INC., Edison, NJ (US)

( * ) Notice: Subject to any disclaimer, the term of this patent is extended or adjusted under 35 U.S.C. 154(b) by 0 days.

(21) Appl. No.: 15/634,683

(22) Filed: Jun. 27, 2017

(65) Prior Publication Data

US 2017/0295911 A1 Oct. 19, 2017

Related U.S. Application Data

(63) Continuation of application No. 12/387,692, filed on May 6, 2009, now Pat. No. 9,687,062.

(51) Int. Cl.
*A45F 3/04* (2006.01)
*A45C 7/00* (2006.01)
(Continued)

(52) U.S. Cl.
CPC ..... *A45F 3/047* (2013.01); *A45C 7/0095* (2013.01); *A45C 13/02* (2013.01); *A45F 3/04* (2013.01);
(Continued)

(58) Field of Classification Search
CPC ... A45C 7/0027; A45C 5/14; A45C 2013/025; A45C 2003/005; A45C 2011/003;
(Continued)

(56) References Cited

U.S. PATENT DOCUMENTS 1,374,126 A 4/1921 Walter
1,416,465 A 5/1922 Harvey
(Continued)

FOREIGN PATENT DOCUMENTS

CA 2518127 A1 * 3/2007 ..... A45C 13/02
EP 797939 A3 7/1998
(Continued)

OTHER PUBLICATIONS

"Checkpoint Friendly Laptop Bag Procedures", Transportation Security Administration Aug. 15, 2008 (Aug. 15, 2008), XP002682908, Retrieved from the Internet: URL:http://www.tsa.gov/press/happenings/simplifying_laptop_bag_procedures.shtm. [retrieved on Sep. 4, 2012]. 3 pages.
(Continued)

*Primary Examiner* — Nathan J Newhouse
*Assistant Examiner* — Matthew T Theis
(74) *Attorney, Agent, or Firm* — Lando & Anastasi, LLP

(57) ABSTRACT

A checkpoint-friendly backpack for allowing a laptop computer stored in a dedicated portion thereof to provide a clear, unobstructed, and distinct image thereof when X-ray screened at an inspection station without having to remove the laptop computer from the dedicated portion. The backpack includes a dedicated compartment and a non-dedicated compartment. The non-dedicated compartment stores items other than the laptop computer. The dedicated compartment stores only the laptop computer itself, is hingedly attached to the non-dedicated compartment at a common edge, is free of metallic snaps, zippers, and buckles, is free of pockets, and has a non-screening mode where it is replaceably fastened in side-by-side relationship to the non-dedicated compartment by a non-metallic zipper so as to facilitate unfastening the dedicated compartment from the non-dedicated compartment, and a screening mode where it is unfastened from the non-dedicated compartment and unfolded therefrom to lie unobstructed, flat, and substantially coplanar with the non-dedicated compartment on the inspection station so as to allow the laptop computer stored in the dedicated compartment to provide the clear, unobstructed, and distinct image thereof when X-ray screened at the inspection station without having to remove the laptop computer from the dedicated compartment.

21 Claims, 6 Drawing Sheets

(51) Int. Cl.
*A45C 13/02* (2006.01)
*A45C 11/00* (2006.01)
*A45F 3/00* (2006.01)

(52) U.S. Cl.
CPC ... *A45C 2011/003* (2013.01); *A45C 2013/025* (2013.01); *A45F 2003/003* (2013.01)

(58) Field of Classification Search
CPC ... A45C 7/0086; A45C 7/0095; A45C 7/0077; A45C 3/02; A45C 7/0045; A45C 2013/306; A45C 7/0054; A45C 13/02; A45F 3/04; A45F 3/047; A45F 2003/003
USPC ..... 224/653, 657, 153, 190, 654, 645, 627, 224/600, 676, 637; 190/109, 110, 111, 190/100, 106, 115; 206/320
See application file for complete search history.

(56) References Cited

U.S. PATENT DOCUMENTS 1,444,112 A 2/1923 Davis
1,556,352 A 10/1925 Ritter
1,658,174 A 2/1928 Russell
1,721,427 A 7/1929 Aldrich
1,826,976 A 10/1931 Wright
1,889,765 A 12/1932 Switkes
2,018,605 A 10/1935 Craig
2,083,029 A 6/1937 Lowy
2,110,163 A 3/1938 Lobel
2,170,841 A 8/1939 Thies et al.
2,187,587 A 1/1940 Plotkin
2,316,328 A 4/1943 Guenther et al.
2,335,779 A 11/1943 Mazzei
2,503,746 A 4/1950 Klehr
2,554,215 A 5/1951 Schell et al.
2,556,066 A 6/1951 Cline
2,574,146 A 11/1951 Gottesman
2,589,438 A 3/1952 Schneider
2,653,709 A 9/1953 Cunningham et al.
2,681,142 A 6/1954 Cohen
2,696,322 A 12/1954 Densen
2,700,460 A 1/1955 Hoover
2,700,518 A 1/1955 Ryno et al.
2,708,989 A 5/1955 Bogdanski
2,769,474 A 11/1956 Klotz
2,771,167 A 11/1956 Lifton
2,771,184 A 11/1956 Ryno et al.
2,785,795 A 3/1957 Ryno et al.
2,800,940 A 7/1957 Riesebeck
2,837,208 A 6/1958 Lingenfelter
2,908,362 A 10/1959 Burtchaell
2,913,080 A 11/1959 Louik et al.
D188,582 S 8/1960 Koffler
3,023,868 A 3/1962 Koffler
3,081,807 A 3/1963 Lightburn
3,115,228 A 12/1963 Louik et al.
3,115,229 A 12/1963 Erhard
3,136,413 A 6/1964 Hall
3,176,742 A 4/1965 Kubnick
3,185,198 A 5/1965 Bryan
3,192,978 A 7/1965 Horvath
3,265,168 A 8/1966 Erhard
3,286,751 A 11/1966 Dishart
3,292,778 A 12/1966 Enderle
3,412,521 A 11/1968 Bauman
3,441,072 A 4/1969 Schmitt
3,497,041 A 2/1970 SamHammer
3,500,973 A 3/1970 Bush
3,529,317 A 9/1970 Schwarzkopf
3,530,213 A 9/1970 Isle
3,531,822 A 10/1970 Bush
3,575,781 A 4/1971 Pezely
3,656,594 A 4/1972 Marks et al.
3,696,850 A * 10/1972 Rosenblum ..... A45C 3/00 190/108
3,698,404 A 10/1972 Greco
3,752,301 A 8/1973 Bluemel
3,813,729 A 6/1974 Szabo et al.
3,853,220 A 12/1974 Luray
3,912,055 A 10/1975 Malooly
3,912,140 A 10/1975 Franges
3,944,033 A 3/1976 Simson
3,949,879 A 4/1976 Peterson et al.
4,013,170 A 3/1977 Hutterer
4,044,867 A 8/1977 Fisher
4,106,597 A 8/1978 Shook et al.
4,114,761 A 9/1978 Kleiner
4,117,933 A 10/1978 Lachance
4,141,401 A 2/1979 Hindemit
4,189,037 A 2/1980 Szabo
4,212,377 A 7/1980 Weinreb
4,213,520 A 7/1980 Sarna et al.
4,259,568 A 3/1981 Dynesen
4,261,078 A 4/1981 Edwards et al.
4,336,883 A 6/1982 Krug et al.
4,339,039 A 7/1982 Mykleby
4,340,990 A 7/1982 Seynhaeve
4,364,150 A 12/1982 Remington
4,378,866 A 4/1983 Pelavin
4,433,781 A 2/1984 Hummel
4,478,450 A 10/1984 Picozza
4,514,876 A 5/1985 Houlberg
4,569,082 A 2/1986 Ainsworth et al.
4,573,202 A 2/1986 Lee
4,620,633 A 11/1986 Lookholder
4,651,872 A 3/1987 Joyce
4,655,418 A 4/1987 Melahn
4,658,298 A 4/1987 Takeda et al.
4,664,254 A 5/1987 Sitwell et al.
4,685,571 A 8/1987 Hoss
4,703,161 A 10/1987 McLean
4,707,883 A 11/1987 Irani et al.
4,722,376 A 2/1988 Rhyner
4,735,320 A 4/1988 Hoss
D297,187 S 8/1988 Kaczmarek
4,762,227 A 8/1988 Patterson
4,817,769 A 4/1989 Saliba
4,828,081 A 5/1989 Nordstrom et al.
4,837,590 A 6/1989 Sprague
4,874,093 A 10/1989 Pharo
4,901,897 A 2/1990 Briggs et al.
4,907,633 A 3/1990 Eckstein
4,919,240 A 4/1990 Tobias
4,946,036 A 8/1990 Kupersmit
5,010,988 A 4/1991 Brown
5,024,328 A 6/1991 Bontrager
5,031,763 A 7/1991 Lynam
5,056,665 A 10/1991 Boecker et al.
5,105,338 A 4/1992 Held
5,105,920 A 4/1992 Grebenstein
5,128,829 A 7/1992 Loew
5,129,519 A 7/1992 David et al.
5,150,776 A 9/1992 Rebenack
5,160,001 A 11/1992 Marceau
5,207,327 A 5/1993 Brondos
5,210,904 A 5/1993 Pratt
5,211,290 A 5/1993 Janus et al.
5,217,119 A 6/1993 Hollingsworth
5,221,005 A 6/1993 Hayward
5,226,542 A 7/1993 Boecker et al.
D338,104 S * 8/1993 Lee ..... D3/287
5,249,653 A 10/1993 King
5,251,102 A 10/1993 Kimble
5,330,049 A 7/1994 Bertelsen et al.
5,341,929 A 8/1994 Stefancin, Jr.
5,348,347 A 9/1994 Shink
5,402,892 A 4/1995 Jaszai
5,445,266 A 8/1995 Prete et al.
5,469,945 A 11/1995 Jserng
5,494,157 A 2/1996 Golenz et al.
5,524,754 A 6/1996 Hollingsworth
5,544,792 A 8/1996 Arnwine
5,555,157 A 9/1996 Moller et al.
5,555,960 A 9/1996 Bartsch

(56) References Cited

U.S. PATENT DOCUMENTS

| | | | |
|---|---|---|---|
| 5,607,054 | A | 3/1997 | Hollingsworth |
| 5,622,262 | A | 4/1997 | Sadow |
| 5,624,035 | A | 4/1997 | Kim |
| 5,676,223 | A | 10/1997 | Cunningham |
| 5,676,509 | A | 10/1997 | Enzu |
| 5,678,666 | A | 10/1997 | Shyr et al. |
| 5,706,935 | A | 1/1998 | Lorton |
| 5,706,992 | A | 1/1998 | Moor |
| 5,725,090 | A | 3/1998 | Vermillion et al. |
| 5,755,329 | A | 5/1998 | Sadow |
| 5,762,170 | A | 6/1998 | Shyr et al. |
| 5,765,688 | A | 6/1998 | Bertram et al. |
| 5,769,231 | A | 6/1998 | Batsford |
| 5,769,232 | A | 6/1998 | Cash et al. |
| 5,775,497 | A | 7/1998 | Krulik |
| 5,788,032 | A | 8/1998 | Krulik |
| 5,797,044 | A | 8/1998 | Lawther et al. |
| 5,808,865 | A | 9/1998 | Alves |
| 5,819,942 | A | 10/1998 | Sadow |
| 5,826,770 | A | 10/1998 | Chuang |
| 5,829,099 | A | 11/1998 | Kopelman et al. |
| 5,833,352 | A | 11/1998 | Goodwin |
| D403,151 | S | 12/1998 | Heredos-Formby |
| 5,857,568 | A | 1/1999 | Speirs |
| 5,881,850 | A | 3/1999 | Murdoch |
| 5,884,768 | A | 3/1999 | Fox |
| 5,887,723 | A | 3/1999 | Myles et al. |
| 5,887,777 | A | 3/1999 | Myles et al. |
| 5,908,147 | A | 6/1999 | Chuang |
| 5,909,759 | A | 6/1999 | Tanaka et al. |
| 5,909,806 | A | 6/1999 | Fischel et al. |
| 5,938,096 | A | 8/1999 | Sauer et al. |
| 5,954,170 | A | 9/1999 | Chisholm |
| 5,960,952 | A | 10/1999 | Chen |
| 5,967,270 | A | 10/1999 | Shyr |
| 5,971,148 | A | 10/1999 | Jackson |
| 5,996,180 | A | 12/1999 | Eisenzopf |
| 6,015,072 | A | 1/2000 | Young |
| 6,024,054 | A | 2/2000 | Matt et al. |
| 6,059,079 | A | 5/2000 | Krulik |
| 6,062,356 | A | 5/2000 | Nykoluk |
| 6,062,357 | A | 5/2000 | Bogert |
| 6,073,770 | A | 6/2000 | Park |
| 6,082,543 | A | 7/2000 | Beliveau |
| 6,098,768 | A | 8/2000 | Tsai |
| 6,105,763 | A | 8/2000 | Saetia |
| 6,105,764 | A | 8/2000 | Scicluna et al. |
| 6,105,766 | A | 8/2000 | Chuang |
| 6,109,434 | A | 8/2000 | Howard, Jr. |
| 6,131,734 | A | 10/2000 | Hollingsworth et al. |
| 6,145,337 | A | 11/2000 | Wilson |
| 6,145,661 | A | 11/2000 | Jung |
| 6,173,933 | B1 | 1/2001 | Whiteside et al. |
| 6,179,431 | B1 | 1/2001 | Chien |
| 6,193,118 | B1 | 2/2001 | Kearl |
| 6,213,266 | B1 | 4/2001 | Hollingsworth |
| 6,213,267 | B1 | 4/2001 | Miller |
| 6,227,339 | B1 | 5/2001 | Bogert |
| 6,237,766 | B1 | 5/2001 | Hollingsworth |
| 6,257,407 | B1 | 7/2001 | Truwit et al. |
| 6,286,645 | B1 | 9/2001 | Chen |
| 6,295,650 | B1 | 10/2001 | Baacke |
| 6,305,587 | B1 | 10/2001 | Miller |
| 6,318,552 | B1 | 11/2001 | Godshaw |
| 6,334,533 | B1 | 1/2002 | Hollingsworth et al. |
| 6,334,534 | B1 | 1/2002 | Hollingsworth et al. |
| 6,338,180 | B1 | 1/2002 | Massard |
| 6,354,477 | B1 | 3/2002 | Trummer |
| 6,360,402 | B1 | 3/2002 | Crabtree |
| 6,390,297 | B1 | 5/2002 | Hollingsworth |
| 6,439,389 | B1 | 8/2002 | Mogil |
| 6,499,187 | B2 | 12/2002 | Hollingsworth |
| 6,535,199 | B1 | 3/2003 | Canova, Jr. et al. |
| D476,149 | S | 6/2003 | Andre et al. |
| 6,629,588 | B2 | 10/2003 | Nykoluk et al. |
| 6,687,955 | B2 | 2/2004 | Hollingsworth |
| 6,746,638 | B1 | 6/2004 | Zadesky et al. |
| 6,772,879 | B1 | 8/2004 | Domotor |
| 6,785,566 | B1 | 8/2004 | Irizarry |
| 6,796,473 | B2 | 9/2004 | Purpura |
| D500,923 | S | 1/2005 | Gonzalez et al. |
| 6,925,739 | B1 | 8/2005 | Cole et al. |
| 6,932,256 | B2 | 8/2005 | Hale et al. |
| 7,048,103 | B2 | 5/2006 | Hollingsworth |
| D527,176 | S | 8/2006 | Andre et al. |
| D529,717 | S | 10/2006 | Brancky |
| D533,348 | S | 12/2006 | Andre et al. |
| 7,207,154 | B2 | 4/2007 | Araujo |
| D541,646 | S | 5/2007 | Hayes et al. |
| 7,216,763 | B2 | 5/2007 | Gormick et al. |
| 7,281,698 | B2 | 10/2007 | Patterson, Jr. |
| D574,375 | S | 8/2008 | Prest et al. |
| D574,819 | S | 8/2008 | Andre et al. |
| 7,414,833 | B2 | 8/2008 | Kittayapong |
| 7,451,872 | B1 | 11/2008 | Allen |
| D582,405 | S | 12/2008 | Andre et al. |
| 7,467,695 | B2 | 12/2008 | Gormick et al. |
| 7,495,895 | B2 | 2/2009 | Carnevali |
| 7,503,440 | B2 | 3/2009 | Gormick et al. |
| 7,735,644 | B2 | 6/2010 | Sirichai et al. |
| D623,404 | S | 9/2010 | Andre et al. |
| D623,638 | S | 9/2010 | Richardson et al. |
| D623,639 | S | 9/2010 | Richardson et al. |
| 7,854,732 | B2 | 12/2010 | Massengale et al. |
| 7,876,550 | B1 | 1/2011 | Albertini et al. |
| 7,975,816 | B1 * | 7/2011 | Lin ..... A45C 7/0027 190/103 |
| 8,051,980 | B2 | 11/2011 | Tai et al. |
| D658,363 | S | 5/2012 | Biddle |
| 8,235,208 | B2 | 8/2012 | Sirichai et al. |
| 8,312,991 | B2 | 11/2012 | Diebel et al. |
| 8,328,008 | B2 | 12/2012 | Diebel et al. |
| 8,567,578 | B2 | 10/2013 | Cuong et al. |
| 2001/0014010 | A1 | 8/2001 | Jenks et al. |
| 2001/0042665 | A1 | 11/2001 | Siwak |
| 2001/0052710 | A1 | 12/2001 | Witherell |
| 2002/0000390 | A1 | 1/2002 | Hollingsworth |
| 2003/0042091 | A1 | 3/2003 | Oh |
| 2003/0132132 | A1 | 7/2003 | Small |
| 2003/0186729 | A1 | 10/2003 | Engstrom et al. |
| 2004/0018863 | A1 | 1/2004 | Engstrom et al. |
| 2005/0072644 | A1 * | 4/2005 | Gormick ..... A45C 3/02 190/111 |
| 2005/0189188 | A1 | 9/2005 | Barnes |
| 2005/0194413 | A1 | 9/2005 | Baker |
| 2007/0051645 | A1 | 3/2007 | Hassett |
| 2007/0056865 | A1 | 3/2007 | Pelo |
| 2007/0057140 | A1 | 3/2007 | Liou et al. |
| 2007/0119734 | A1 | 5/2007 | Pichahchi |
| 2007/0137959 | A1 | 6/2007 | Zauderer |
| 2007/0205122 | A1 | 9/2007 | Oda et al. |
| 2007/0279855 | A1 | 12/2007 | Linsmeier et al. |
| 2008/0055835 | A1 | 3/2008 | Kumano et al. |
| 2008/0237432 | A1 | 10/2008 | Patterson |
| 2008/0251339 | A1 | 10/2008 | Williams |
| 2009/0139814 | A1 | 6/2009 | Grossman et al. |
| 2009/0205985 | A1 | 8/2009 | Freeman et al. |
| 2009/0223765 | A1 | 9/2009 | Bosma |
| 2009/0223845 | A1 | 9/2009 | Bosma et al. |
| 2009/0238335 | A1 | 9/2009 | Ripp et al. |
| 2009/0294235 | A1 | 12/2009 | Santy et al. |
| 2009/0314594 | A1 * | 12/2009 | Harrison ..... A45C 3/02 190/109 |
| 2010/0072334 | A1 | 3/2010 | Le Gette et al. |
| 2011/0315579 | A1 | 12/2011 | Mase |

FOREIGN PATENT DOCUMENTS

| | | | |
|---|---|---|---|
| FR | 2391668 | A1 | 12/1978 |
| FR | 2760333 | A1 | 9/1998 |
| GB | 146601 | A | 7/1920 |
| GB | 161117 | A | 4/1921 |
| JP | 3222728 | | 10/1991 |
| JP | H073344 | U | 1/1995 |

(56) References Cited

FOREIGN PATENT DOCUMENTS

| | | | |
|---|---|---|---|
| JP | 2000014426 | A | 1/2000 |
| JP | 2000217622 | A | 8/2000 |
| JP | 2004509680 | A | 4/2004 |
| JP | 2004231158 | A | 8/2004 |
| KR | 100362369 | B1 | 11/2002 |
| WO | 2010036090 | A2 | 4/2010 |
| WO | 2011115918 | A1 | 9/2011 |

OTHER PUBLICATIONS

"Mobile Edge-16 ScanFast Backpack", Buy.com Inc., Jan. 15, 2008 (Jan. 15, 2008), XP002682907, Retrieved from the Internet: URL:http://www.buy.com/prod/mobile-edge-16-scanfast-backpack/208898225.html. [retrieved on Sep. 4, 2012]. 3 pages.

"Targus Zip-Thru Air Traveler BAckpack", Buy.com Inc., Mar. 12, 2009 (Mar. 12, 2009), XP002682906, Mar. 12, 2009 (Mar. 12, 2009), XP002682906, Retrieved from the Internet: URL:http://www.buy.com/prod/targus-zip-thru-air-travelr-backpack/210594250. html [retrieved on Sep. 4, 2012]. 4 pages. Targus Zip-Thru Air Traveler BAckpack, Buy.com Inc., Mar. 12, 2009 (Mar. 12, 2009), XP002682906, Mar. 12, 2009 (Mar. 12, 2009), XP002682906, Retrieved from the Internet: URL:http://www.buy.com/prod/targus-zip-thru-air-travelr-backpack/210594250.html [retrieved on Sep. 4, 2012].

* cited by examiner

CHECKPOINT-FRIENDLY BACKPACK

CROSS REFERENCE TO RELATED APPLICATIONS

The present application is a continuation of and claims priority to U.S. patent application Ser. No. 12/387,692, filed May 6, 2009, and issued on Jun. 27, 2017 as U.S. Pat. No. 9,687,062, which is incorporated herein by reference in its entirety.

1. THE BACKGROUND OF THE INVENTION

A. The Field of the Invention

The embodiments of the present invention relate to a backpack for a laptop computer, and more particularly, the embodiments of the present invention relate to a checkpoint-friendly backpack for allowing a laptop computer stored in a dedicated portion thereof to provide a clear, unobstructed, and distinct image thereof when X-ray screened at an inspection station without having to remove the laptop computer from the dedicated portion.

B. The Description of the Prior Art

Since 9/11, the world of public transportation has changed significantly. In fact, there is now a government agency—the Transportation Security Agency ("TSA")—that is responsible for the heightened security at airports and other facilities. The security measures taken by TSA personnel to check each passenger and all packages carried on-board airplanes has resulted in long lines and increased pre-flight boarding times.

While TSA personnel use sophisticated instruments to determine the presence of illegal compounds and objects, there remains a requirement for visual inspection of certain devices, Packages, boxes, and carry-on bags must be opened for these visual inspections, with the opening and closing of these articles adding to the delays of clearing security points.

The laptop computer has become a normal accessory for many travelers, both for work and entertainment during a trip. The conventional laptop computer has no integrated carrying devices, and therefore, usually is placed in a carry case. Most cases have various pockets and compartments to carry peripheral equipment and other things the owner may include with the laptop computer. The carrying cases tray be made of soft or hard materials, which may be padded, and which completely enclose the laptop computer for protection.

To help streamline the security process and better protect laptops, the TSA now allows passengers to leave their laptop computers in backpacks that meet the "checkpoint friendly" standards. For a backpack to be considered "checkpoint friendly," it must meet the following standards:

- Have a designated laptop-only section;
- Allow the laptop-only section to completely unfold to lie flat on the X-ray belt;
- Have no metal snaps, zippers, or buckles inside, underneath, or on top of the laptop-only section;
- Have no pockets on the inside or outside of the laptop-only section; and
- Have nothing packed in the laptop-only section other than the laptop computer itself.

Thus, there exists a need for a laptop backpack to be checkpoint friendly by having a designated laptop-only section, by allowing the laptop-only section to completely unfold to lie flat on the X-ray belt, by having no metal snaps, zippers, or buckles inside, underneath, or on top of the laptop-only section, by having no pockets on the inside or outside of the laptop-only section, and by having nothing packed in the laptop-only section other than the laptop computer itself.

Numerous innovations for laptop backpacks have been provided in the prior art, which will be described below in chronological order to show advancement in the art, and which are incorporated herein by reference thereto. Even though these innovations may be suitable for the individual purposes that they address, nevertheless, they differ from the embodiments of the present invention in that they do not teach a checkpoint-friendly backpack for allowing a laptop computer stored in a dedicated portion thereof to provide a clear, unobstructed, and distinct image thereof when X-ray screened at an inspection station without having to remove the laptop computer from the dedicated portion.

(1) U.S. Pat. No. 5,544,792 to Arnwine.

U.S. Pat. No. 5,544,792 issued to Arnwine on Aug. 13, 1996 in U.S. class 224 and subclass 153 teaches a book bag having a primary compartment and a plurality of substantially identical secondary compartments that are designed to function independently of each other while in a unitary arraignment. The compartments can be converted to a fully open relationship that allows for easy storage into narrow upright lockers. Each compartment has inner and outer parallel side panels connected by a bottom, a top, and two ends. The compartments are interconnected in a side-by-side relationship to the side panel of a mating compartment by zipper elements. Secured to the inner panel of each compartment is a shoulder harness to allow the book bag to be carried in a typical fashion on one's back. Individual compartments may also be carried by a handle secured to the top. Centrally positioned on the outer side panel is an expandable envelope designed for easy retrial of homework assignments or the like. Pockets are also provided on the ends of a compartment for storage of pens, rulers, pencils, or other school supplies. Near the outer side panel along the ends and top extends a U-shaped closure apparatus that when opened allows for entry within each compartment.

(2) U.S. Pat. No. 5,706,992 to Moor.

U.S. Pat. No. 5,706,992 issued to Moor on Jan. 13, 1998 in U.S. class 224 and subclass 657 teaches a backpack for carrying a laptop computer, which includes: flexible front, rear, bottom, and side panels, the interior surfaces of which define the interior of the backpack, and the side panel extends along each side and across the top of the backpack, and the front, rear, and side panels are joined together along their perimeters; a compartment for storing a laptop computer in the interior of the backpack; a first closure apparatus extending longitudinally along the side panel and transversely across the top to control access to the compartment; at least one adjustable interlocking assembly joined to the backpack so as to bridge the first closure at the bottom half of the backpack, whereby pivotal separation of the first closure along the side and the top panels is restricted to a predetermined interval when the closure apparatus is opened; and a pair of adjustable shoulder straps connected to the exterior of the rear panel for carrying the backpack.

(3) U.S. Pat. No. 6,015,072 to Young.

U.S. Pat. No. 6,015,072 issued to Young on Jan. 18, 2000 in U.S. class 224 and subclass 153 teaches a combination collapsible backpack and lined compartment that includes a backpack formed of a back section, a front section, and a bottom section attached-to the front section and the back section. The backpack further includes a pair of shoulder straps attached to the back section. The backpack may be collapsed onto the bottom section of the backpack. An upper lid is attached to the backpack. The lid attachment attaches the bottom section of the backpack and the upper lid when the backpack is collapsed onto the bottom section of the backpack, so that the collapsed backpack is between the bottom section of the backpack and the lid. A carrying compartment has side walls and a bottom wall. A compartment attachment attaches the side walls of the carrying compartment to the bottom section of the backpack, so that the bottom section of the backpack forms a top section of the carrying compartment. A liner having side walls and a bottom wall that substantially correspond with the side walls and bottom section of the carrying compartment is removably placed in the carrying compartment. A liner attachment detachably attaches the side walls of the liner with the side walls of the first compartment.

(4) U.S. Pat. No. 6,305,587 B1 to Miller.

U.S. Pat. No. 6,305,587 B1 issued to Miller on Oct. 23, 2001 in US class 224 and subclass 153 teaches a computer tote that is convertible from a hand-carried attache case to a shoulder-carried backpack. As an attache case, the computer tote may be carried by retractable handles. A convertible compartment houses a shoulder harness and a backpack compartment in a small, compact manner. The convertible compartment can be opened, so that the harness and backpack compartment can be unfolded. The backpack compartment expands the size of the case so as to allow additional items to be carried therein. The shoulder harness facilitates carrying the expanded tote on a user's back. The computer case has numerous other interior and exterior zippered compartments including a computer compartment. The Computer compartment is sized for securely containing a portable computer, and is lined with a padded board for protecting the computer.

(5) U.S. Pat. No. 6,796,473 B2 to Purpura.

U.S. Pat. No. 6,796,473 B2 issued to Purpura on Sep. 28, 2004 in U.S. class 224 and subclass 576 teaches a laptop computer transport and support system for a mobile environment, such as an airplane, a bus, or a train, is embodied as a wheeled clamshell style backpack carrying case with a retractable handle. The system is employed by unzipping three case edges and lifting a hinged protective cover thereby exposing a computer. The backpack straps unhook from the cover and secure to a user's seatback or around a user's headrest, while strap posts at an opposite backpack strap end extend from the case and prevent strap interference with the user. A foldable or detachable handle permits retractable handle posts to extend on each side of the user and support the system against the seatback, instead of the user when the system is used. Optionally, computer peripherals within a compartmentalized base are connected within the base to a docking station port and provide the computer with quick access to the peripherals.

(6) U.S. Pat. No. 6,932,256 B2 to Hale Et Al.

U.S. Pat. No. 6,932,256 B2 issued to Hale et al. on Aug. 23, 2005 in U.S. class 224 and subclass 637 teaches a pack for carrying school books and other items, with the weight substantially balanced between the front and back of a wearer. A yoke has front and back pouches and an opening for the wearer's head. The sides of the front and back portions of the yoke are releasably connected by flaps at the sides of the back portion, which engage a strip of hook-and-loop material on the front pouch. An auxiliary bag is detachably connected to the back pouch.

(7) United States Patent Application Publication Number US 2005/0189188 A1 to Barnes.

United States Patent Application Publication Number US 2005/0189188 A1 published to Barnes on Sep. 1, 2005 in U.S. class 190 and subclass 110 teaches a protective case for carrying a portable laptop computer within a larger bag. The case includes a padded sleeve that slides within a rigid pocket that is removably attached to the inside of the larger bag. It further provides a modular system of interchangeable bags, padded sleeves, and rigid pockets.

It is apparent that numerous innovations for laptop backpacks have been provided in the prior art, which are adapted to be used. Furthermore, even though these innovations may be suitable for the individual purposes to which they address, nevertheless, they would not be suitable for the purposes of the embodiments of the present invention as heretofore described, namely, a checkpoint-friendly backpack for allowing a laptop computer stored in a dedicated portion thereof to provide a clear, unobstructed, and distinct image thereof when X-ray screened at an inspection station without having to remove the laptop computer from the dedicated portion.

2. THE SUMMARY OF THE INVENTION

Thus, an object of the embodiments of the present invention is to provide a checkpoint-friendly backpack for allowing a laptop computer stored in a dedicated portion thereof to provide a clear, unobstructed, and distinct image thereof when X-ray screened at an inspection station without having to remove the laptop computer from the dedicated portion, which avoids the disadvantages of the prior art.

Briefly stated, another object of the embodiments of the present invention is to provide a checkpoint-friendly backpack for allowing a laptop computer stored in a dedicated portion thereof to provide a clear, unobstructed, and distinct image thereof when X-ray screened at an inspection station without having to remove the laptop computer from the dedicated portion. The backpack includes a dedicated compartment and a non-dedicated compartment. The non-dedicated compartment stores items other than the laptop computer. The dedicated compartment stores only the laptop computer itself, is hingedly attached to the non-dedicated compartment at a common edge, is free of metallic snaps, metallic zippers, and metallic buckles, is free of pockets, and has a non-screening mode where it is replaceably fastened in side-by-side relationship to the non-dedicated compartment by a non-metallic zipper so as to facilitate unfastening the dedicated compartment from the non-dedicated compartment, and a screening mode where it is unfastened from the non-dedicated compartment and unfolded therefrom to lie unobstructed, flat, and substantially coplanar with the non-dedicated compartment on the inspection station so as to allow the laptop computer stored in the dedicated compartment to provide the clear, unobstructed, and distinct image thereof when X-ray screened at the inspection station without having to remove the laptop computer from the dedicated compartment.

The novel features considered characteristic of the embodiments of the present invention are set forth in the appended claims. The embodiments of the present invention themselves, however, both as to their construction and their method of operation together with additional objects and advantages thereof will be best understood from the following description of the specific embodiments when read and understood in connection with the accompanying drawing.

3. THE BRIEF DESCRIPTION OF THE DRAWING

The figures of the drawing are briefly described as follows.

4. THE LIST OF REFERENCE NUMERALS UTILIZED IN THE DRAWING

Figure 1:
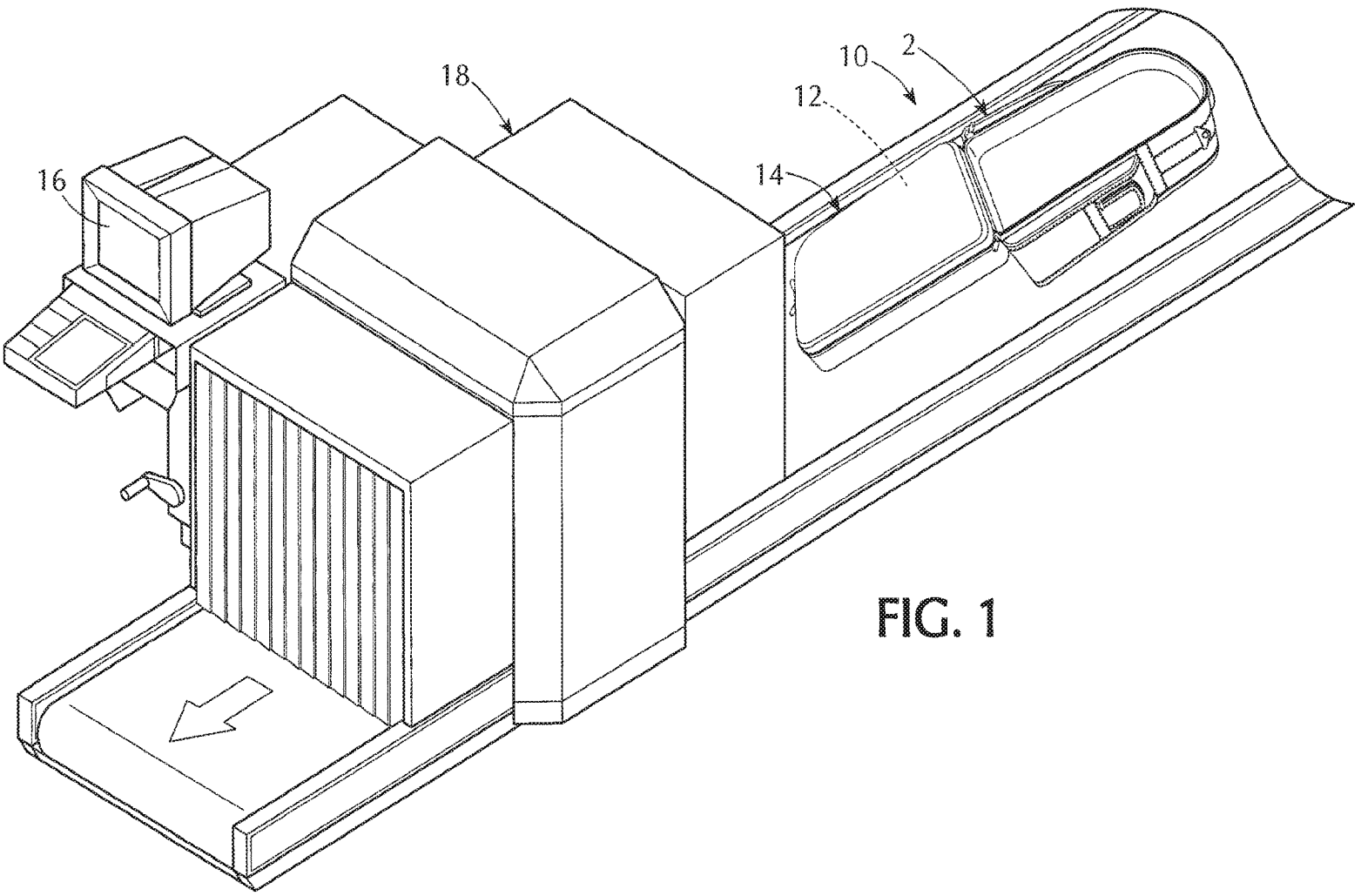
FIG. 1 is a diagrammatic perspective view of the checkpoint-friendly backpack of the embodiments of the present invention allowing a laptop computer stored in a dedicated portion thereof to provide a clear, unobstructed, and distinct image thereof when X-ray screened at an inspection station without having to remove the laptop computer from the dedicated portion.
Figure 2:
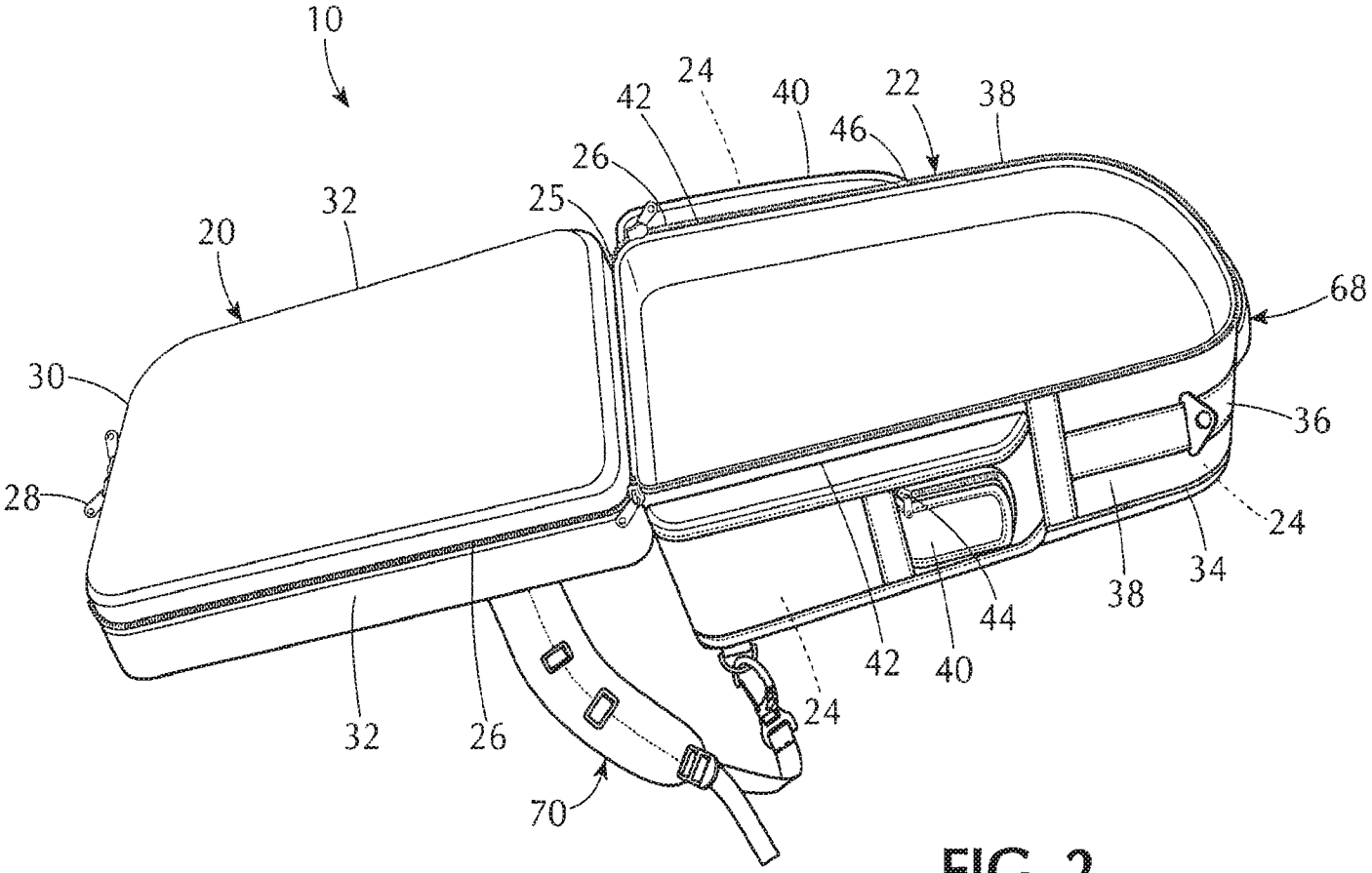
FIG. 2 is an enlarged diagrammatic perspective view of the checkpoint-friendly backpack in the X-ray screening mode identified by ARROW 2 in FIG. 1.

A. General.

10 checkpoint-friendly backpack of embodiments of present invention for allowing laptop computer 12 stored in dedicated portion 14 thereof to provide clear, unobstructed, and distinct image 16 thereof when X-ray screened at inspection station 18 without having to remove laptop computer 12 from dedicated portion 14

12 laptop computer

14 dedicated portion

16 clear, unobstructed, and distinct image

18 inspection station

B. Configuration of Checkpoint-Friendly Backpack 10.

20 dedicated compartment

22 non-dedicated compartment

24 items other than laptop computer 12

25 common edge

26 first non-metallic zipper

28 second non-metallic zipper

30 top wall of dedicated compartment 20

32 pair of side walls of dedicated compartment 20

34 third non-metallic zipper

36 top wall of non-dedicated compartment 22

38 pair of side walls of non-dedicated compartment 22

40 pair of first expandable side pockets

42 lower portions of pair of side walls 38 of non-dedicated compartment 22, respectively

44 fourth non-metallic zipper

46 fifth non-metallic zipper

48 outer wall of non-dedicated compartment 22

50 second expandable pocket

52 upper portion of outer wall 48 of non-dedicated compartment 22

54 third expandable pocket

56 intermediate portion of outer wall 48 of non-dedicated compartment 22

58 fourth expandable pocket

60 lower portion of outer wall 48 of non-dedicated compartment 22

62 sixth non-metallic zipper

64 seventh non-metallic zipper

66 eighth non-metallic zipper

68 handle

70 pair of shoulder strap of dedicated compartment 20

5. THE DETAILED DESCRIPTION OF THE PREFERRED EMBODIMENTS

A. General.

Referring now to the figures, in which like numerals indicate like parts, and particularly to FIG. 1, which is a diagrammatic perspective view of the checkpoint-friendly backpack of the embodiments of the present invention allowing a laptop computer stored in a dedicated portion thereof to provide a clear, unobstructed, and distinct image thereof when X-ray screened at an inspection station without having to remove the laptop computer from the dedicated portion, the checkpoint-friendly backpack of the embodiments of the present invention is shown generally at 10 for allowing a laptop computer 12 stored in a dedicated portion 14 thereof to provide a clear, unobstructed, and distinct image 16 thereof when X-ray screened at an inspection station 18 without having to remove the laptop computer 12 from the dedicated portion 14.

B. The Configuration of the Checkpoint-Friendly Backpack 10.

Figure 3:
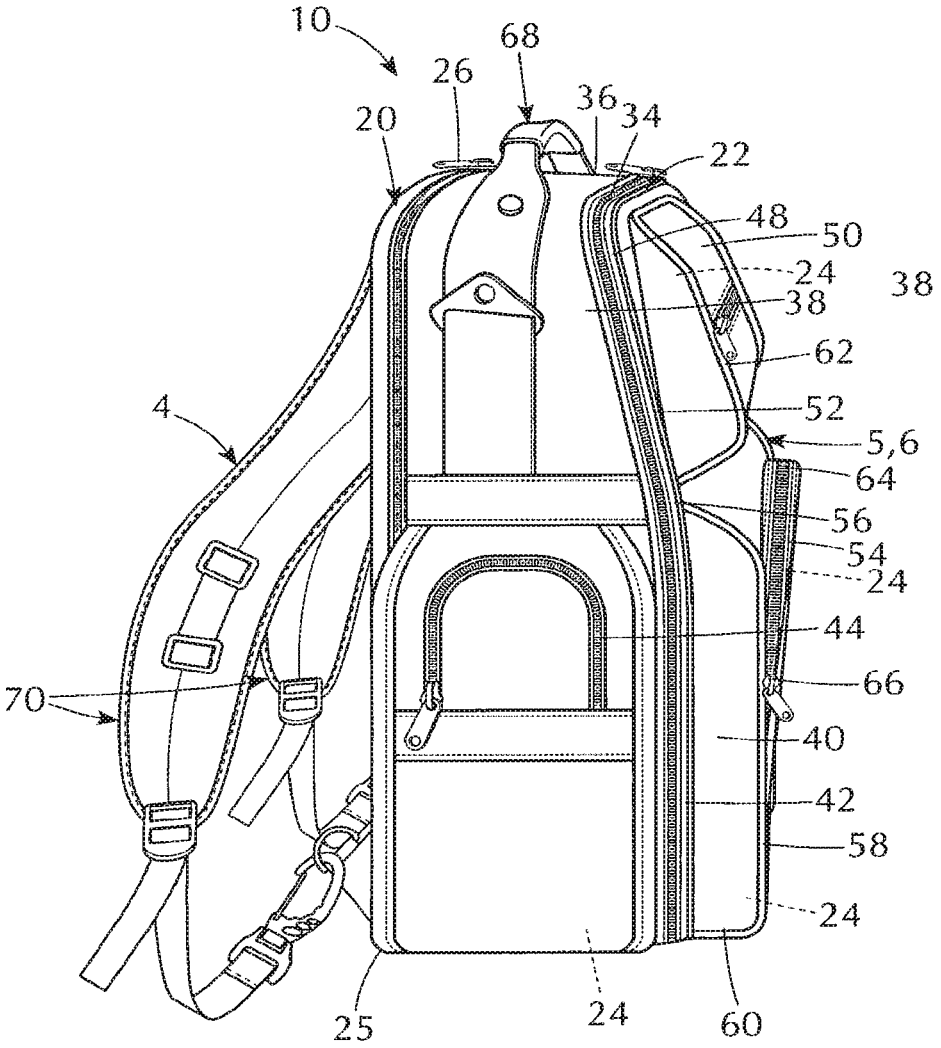
FIG. 3 is a diagrammatic perspective view of the checkpoint-friendly backpack in the non-X-ray screening mode.
Figure 4:
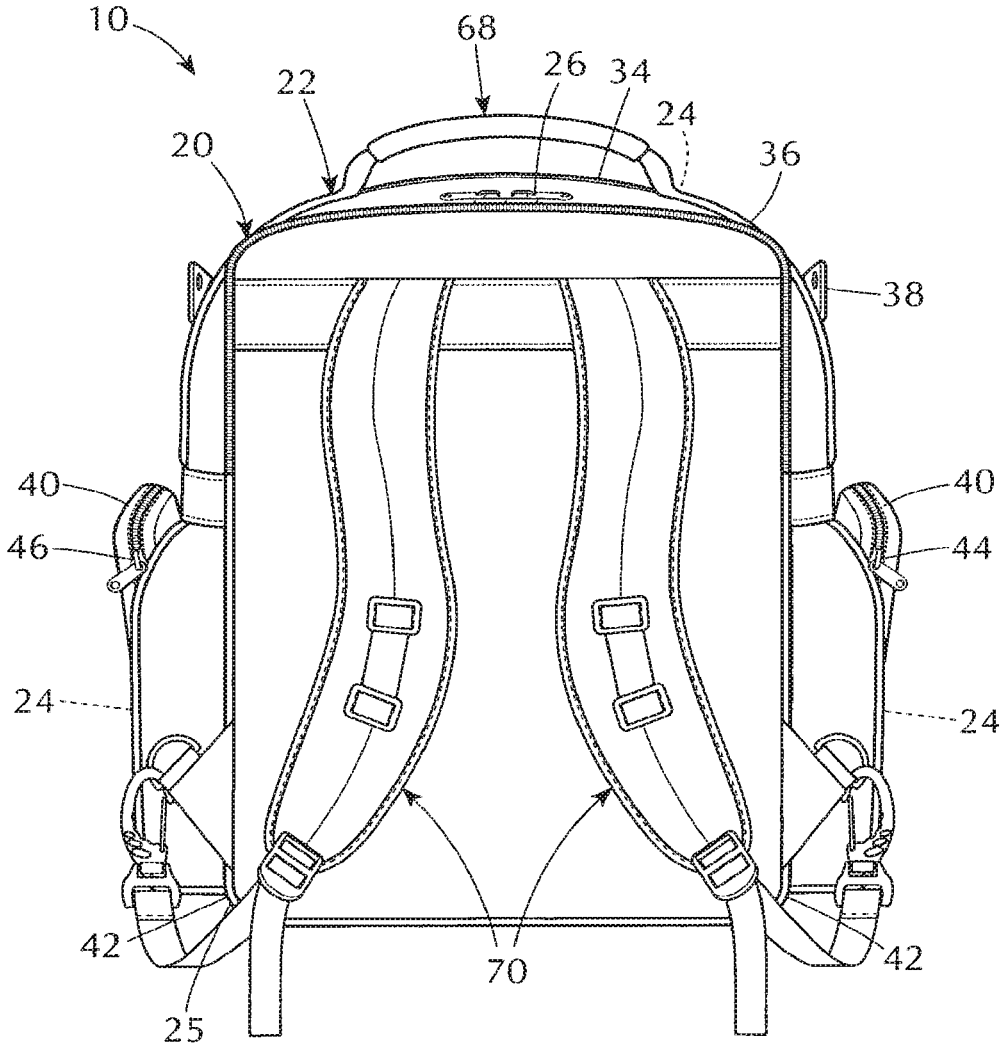
FIG. 4 is a diagrammatic rear elevational perspective view taken generally in the direction of ARROW 4 in FIG. 3.
Figure 5:
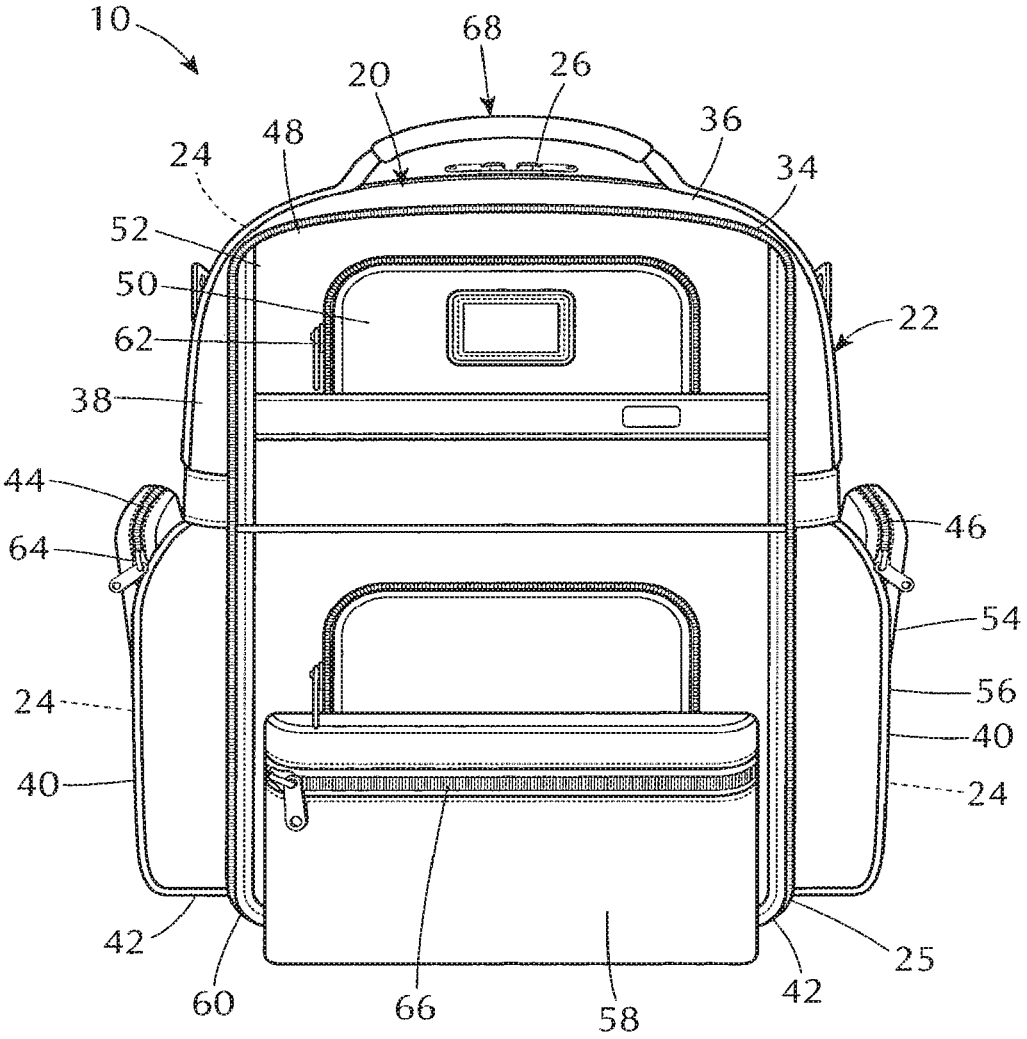
FIG. 5 is a diagrammatic front elevational perspective view taken generally in the direction of ARROW 5 in FIG. 3, with the non-dedicated compartment closed.
Figure 6:
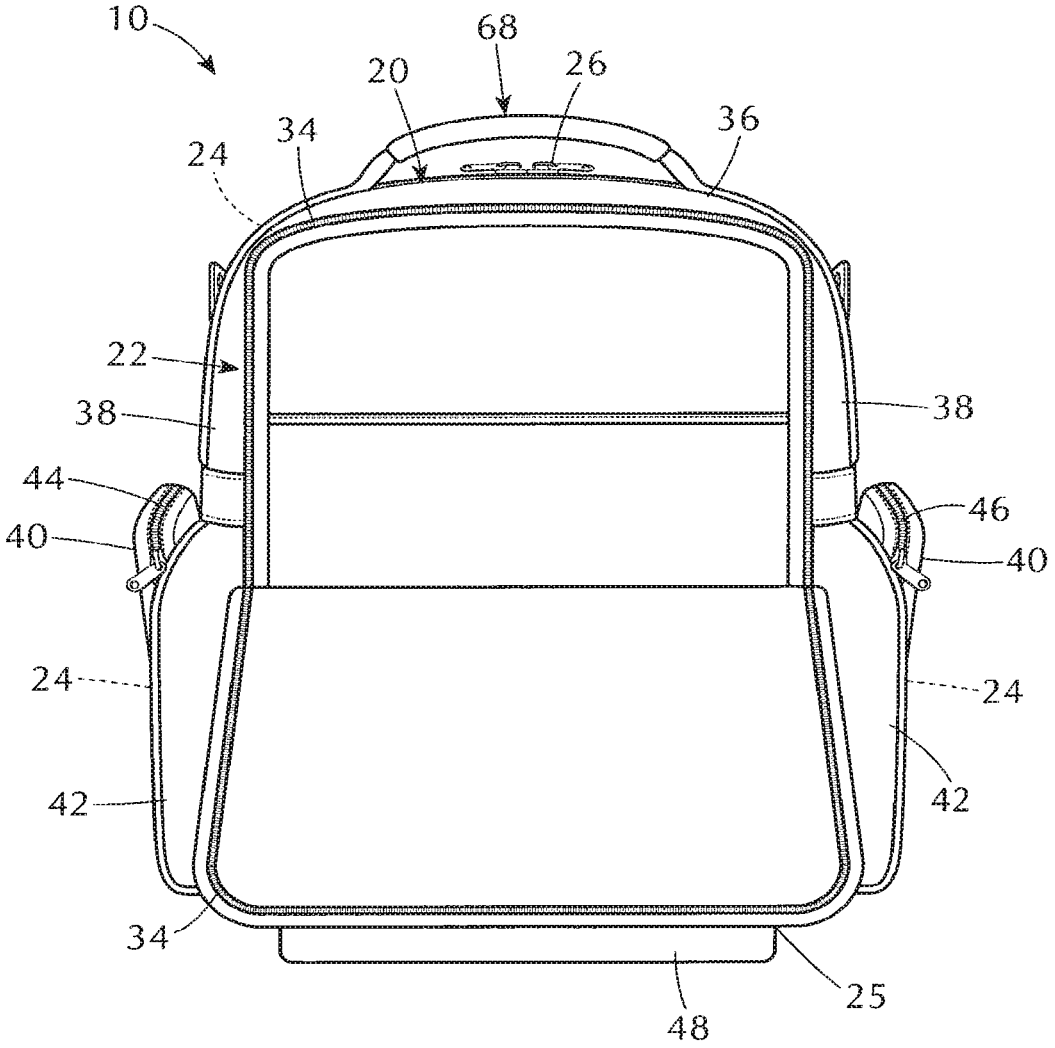
FIG. 6 is a diagrammatic front elevational perspective view taken generally in the direction of ARROW 6 in FIG. 3, with the non-dedicated compartment opened.

The configuration of the checkpoint-friendly backpack 10 can best be seen in FIGS. 2-6, which are, respectively, an enlarged diagrammatic perspective view of the checkpoint-friendly backpack in the X-ray screening mode identified by ARROW 2 in FIG. 1, a diagrammatic perspective view of the checkpoint-friendly backpack in the non-X-ray screening mode, a diagrammatic rear elevational perspective view taken generally in the direction of ARROW 4 in FIG. 3, a diagrammatic front elevational perspective view taken generally in the direction of ARROW 5 in FIG. 3, with the non-dedicated compartment closed, and a diagrammatic front elevational perspective view taken generally in the direction of ARROW 6 in FIG. 3, with the non-dedicated compartment opened, and as such, will be discussed with reference thereto.

The checkpoint-friendly backpack 10 comprises a dedicated compartment 20 and a non-dedicated compartment 22. The non-dedicated compartment 22 stores items 24 other than the laptop computer 12. The dedicated compartment 20 stores only the laptop computer 12 itself, is hingedly attached to the non-dedicated compartment 22 at a common edge 25, is free of metallic snaps, metallic zippers, and metallic buckles, is free of pockets, and has a non-screening mode where it is replaceably fastened in side-by-side relationship to the non-dedicated compartment 22 by a first non-metallic zipper 26 so as to facilitate unfastening the dedicated compartment 20 from the non-dedicated compartment 22, and a screening mode where it is unfastened from the non-dedicated compartment 22 and unfolded therefrom to lie unobstructed, flat, and substantially coplanar with the non-dedicated compartment 22 on the inspection station 18 so as to allow the laptop computer 12 stored in the dedicated compartment 20 to provide the clear, unobstructed, and distinct image 16 thereof when X-ray screened at the inspection station 18 without having to remove the laptop computer 12 from the dedicated compartment 20.

The dedicated compartment 20 is accessible for the laptop computer 12 via a second non-metallic zipper 28. The second non-metallic zipper 28 is disposed continuously on a top wall 30 and on a pair of side walls 32 of the dedicated compartment 20.

The non-dedicated compartment 22 is accessible for the items 24 other than the laptop computer 12 via a third non-metallic zipper 34. The third non-metallic zipper 34 is disposed continuously on a top wall 36 and a pair of side walls 38 of the non-dedicated compartment 22.

The non-dedicated compartment 22 further comprises a pair of first expandable side pockets 40. The pair of first expandable side pockets 40 are disposed on the side walls 38 of the non-dedicated compartment 22, at lower portions 42 thereof, respectively, for storing the items 24 other than the laptop computer 12.

The pair of first expandable side pockets 40 of the non-dedicated compartment 22 are accessible via a fourth non-metallic zipper 44 and a fifth non-metallic zipper 46, respectively.

An outer wall 48 of the non-dedicated compartment 22 harbors a second expandable pocket 50 on an upper portion 52 thereof, a third expandable pocket 54 on an intermediate portion 56 thereof, and a fourth expandable pocket 58 on a lower portion 60 thereof.

The second expandable pocket 50, the third expandable pocket 54, and the fourth expandable pocket 58 are accessible for the items 24 other than the laptop computer 12 via a sixth non-metallic zipper 62, a seventh non-metallic zipper 64, and an eighth non-metallic zipper 66.

The checkpoint-friendly backpack 10 further comprises a handle 68. The handle 68 is attached to the top wall 36 of the non-dedicated compartment 22.

The checkpoint-friendly backpack 10 further comprises a pair of shoulder straps 70. The pair of shoulder straps 70 extend from the dedicated compartment 20.

C. The Impressions.

It will be understood that each of the elements described above or two or more together may also find a useful application in other types of constructions differing from the types described above.

While the embodiments of the present invention have been illustrated and described as embodied in a checkpoint-friendly backpack, however, they are not limited to the details shown, since it will be understood that various omissions, modifications, substitutions, and changes in the forms and details of the embodiments of the present invention illustrated and their operation can be made by those skilled in the art without departing in any way from the spirit of the embodiments of the present invention.

Without further analysis, the foregoing will so fully reveal the gist of the embodiments of the present invention that others can by applying current knowledge readily adapt them for various applications without omitting features that from the standpoint of prior art fairly constitute characteristics of the generic or specific aspects of the embodiments of the present invention.

The invention claimed is:

1. A backpack for allowing a computer to be stored therein when scanned at an inspection station without having to remove the computer therefrom, the backpack comprising:

a dedicated compartment for storing the computer, the dedicated compartment comprising a single closeable pocket formed by a first interior wall, a first exterior wall, a first bottom wall, and at least one first sidewall coupling the first interior wall and the first exterior wall to provide first side walls of the dedicated compartment except for the first bottom wall, and including a first fastener for enclosing the computer within the dedicated compartment;

a non-dedicated compartment comprising at least one pocket or pouch formed by a second interior wall, a second exterior wall, a second bottom wall and at least one second sidewall coupling the second interior wall and the second exterior wall to provide second side walls of the non-dedicated compartment except for the second bottom wall, and including a second fastener for enclosing the non-dedicated compartment;

wherein a common edge between a respective portion of the first bottom wall of the dedicated compartment and the second bottom wall of the non-dedicated compartment form a living hinge, the backpack configured with a third fastener to provide movement between a screening mode in which the first interior wall of the dedicated compartment is separated from the second interior wall of the non-dedicated compartment and is connected by the living hinge, and a non-screening mode in which the first interior wall is adjacent the second interior wall and the first fastener and an exterior portion of the first sidewall is disposed partially within an interior portion of the second sidewall along substantially the entire length of the first sidewall and second sidewall; and the third fastener facilitating fastening between the dedicated compartment and the non-dedicated compartment while in the non-screening mode, and facilitating separation between the dedicated compartment and the non-dedicated compartment while in the screening mode, wherein the first fastener is a zipper.

2. The backpack of claim 1, wherein the exterior portion of the first sidewall is disposed flush against the interior portion of the second sidewall.

3. The backpack of claim 2, wherein at least one side of the dedicated compartment is lined with a padded material configured to protect the computer.

4. The backpack of claim 3, wherein the non-dedicated compartment includes a first non-metallic zipper for accessing items other than the computer.

5. The backpack of claim 4, wherein the first non-metallic zipper is disposed continuously along the second sidewall.

6. The backpack of claim 5, wherein the non-dedicated compartment comprises a pair of expandable side pockets.

7. The backpack of claim 6, wherein the pair of expandable side pockets are disposed on at least one of the second side walls of the non-dedicated compartment, at lower portions thereof, respectively, for storing the items other than the computer.

8. The backpack of claim 7, wherein each of the pair of expandable side pockets are accessible via a second and third non-metallic zipper, respectively.

9. The backpack of claim 8, wherein the second exterior wall includes a first expandable pocket disposed on an upper portion thereof.

10. The backpack of claim 9, wherein the second exterior wall includes a second expandable pocket disposed on an intermediate portion thereof.

11. The backpack of claim 10, wherein at least one of the first and second expandable pockets is accessible via corresponding additional non-metallic zippers.

12. A computer case for allowing a computer held within the case to be scanned at a security or inspection station without having to remove the computer therefrom, the computer case comprising:

a first dedicated storage compartment for housing a computer comprising a first outer wall, a first inner wall, a first bottom wall, a first top end opposite the first bottom wall, and at least one first sidewall coupling the first inner wall and the first outer wall to provide first side walls except for the first bottom wall, all defining the first storage compartment having a first opening, and a first fastener configured to secure the first opening and thereby retain a computer therein, wherein the first dedicated storage compartment is configured to enable a scanning device to scan an interior of the first dedicated storage compartment without removing the computer therefrom;

a second storage compartment comprising a second outer wall, a second inner wall, a second bottom wall, a second top end opposite the second bottom wall, and at least one second sidewall coupling the second inner wall and the second outer wall to provide second side walls except for the second bottom wall, all defining the second storage compartment having a second opening, and a second fastener configured to substantially enclose the second opening of the second storage compartment;

wherein the first storage compartment is joined at a first edge of the first bottom wall to a second edge of the second bottom wall such that the first edge of first bottom wall and the second edge of the second bottom wall are coupled to form a hinge between the first dedicated storage compartment and the second storage compartment;

wherein the first inner wall and second inner wall are disposed adjacent one another in a non-screening mode and can be separated to lie substantially on a planar surface in a screening mode, wherein the first top end and the second top end are disposed adjacent one another in the non-screening mode and can be separated from one another in the screening mode;

wherein in the screening mode with the outer walls of both the first dedicated storage compartment and the second storage compartment laid flat upon the same surface, a computer in the first dedicated storage compartment can be scanned by a scanning device without removing the computer therefrom; and wherein in the non-screening mode with the first inner wall and second inner wall disposed adjacent one another, the first fastener and an exterior portion of the first sidewall is disposed partially within an interior portion of the second sidewall along substantially the entire length of the first sidewall and the second sidewall, and wherein the first fastener is a zipper.

13. The computer case of claim 12, wherein the exterior portion of the first sidewall is disposed flush against the interior portion of the second sidewall.

14. The computer case of claim 13, wherein at least one side of the first dedicated storage compartment is lined with a padded material configured to protect the computer.

15. The computer case of claim 14, further comprising:

a pair of shoulder straps extending away from the first dedicated storage compartment or the second storage compartment; and a handle attached to an upper portion of the first dedicated storage compartment or the second storage compartment.

16. The computer case of claim 15, wherein the second storage compartment comprises at least one expandable side pocket.

17. The computer case of claim 16, wherein the second storage compartment comprises at least one additional side pocket disposed on an upper, middle, or lower portion thereof.

18. The computer case of claim 17, wherein the second storage compartment is accessible via a first non-metallic zipper disposed continuously around at least three sides of the second storage compartment.

19. The computer case of claim 18, wherein the at least one expandable side pocket is accessible via a second non-metallic zipper.

20. The computer case of claim 19, wherein the at least one additional pocket disposed on an upper, middle, or lower portion of the second storage compartment is accessible via a third non-metallic zipper.

21. The backpack of claim 1, wherein the length extends vertically upwardly from the living hinge in the non-screening mode.

* * * * *